US006179697B1

(12) United States Patent
Shibai

(10) Patent No.: US 6,179,697 B1
(45) **Date of Patent: *Jan. 30, 2001**

(54) GRINDSTONE ADAPTER

(75) Inventor: Yoshio Shibai, Uji (JP)

(73) Assignee: Sanwa Kenma Kogyo Co., Ltd., Uji (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/266,900

(22) Filed: Mar. 12, 1999

(30) Foreign Application Priority Data

Mar. 18, 1998 (JP) ..... 10-068969

(51) Int. Cl.[7] ..... B24B 27/08

(52) U.S. Cl. ..... 451/359; 451/514; 451/515; 451/508

(58) Field of Search ..... 451/342, 359, 451/450, 508, 514, 515, 519

(56) References Cited

U.S. PATENT DOCUMENTS

| | | | | |
|---|---|---|---|---|
| 524,572 | * | 8/1894 | Beckert | 451/450 |
| 927,164 | * | 7/1909 | Puffer | 451/450 |
| 1,600,054 | * | 9/1926 | MacLaughlin et al. | 451/450 |
| 2,290,215 | * | 7/1942 | Stenberg | 451/342 |
| 2,671,994 | * | 3/1954 | Hickman | 451/508 |
| 2,697,878 | * | 12/1954 | Oberley | 451/450 |
| 2,840,960 | * | 7/1958 | Booth | 451/450 |
| 3,376,675 | * | 4/1968 | Hutchins | 451/508 |
| 3,436,875 | * | 4/1969 | Cheney | 451/508 |
| 3,783,729 | * | 1/1974 | Parr | 451/342 |
| 3,912,411 | * | 10/1975 | Moffat | 451/342 |
| 4,809,465 | * | 3/1989 | Mushardt et al. | 451/432 |
| 4,980,994 | * | 1/1991 | Helm et al. | 451/342 |
| 5,688,163 | * | 11/1997 | Siden | 451/342 |

FOREIGN PATENT DOCUMENTS

| | | |
|---|---|---|
| 62-8063 | 1/1962 | (JP) . |
| 58-8562 | 1/1983 | (JP) . |
| 58-55845 | 4/1983 | (JP) . |

* cited by examiner

*Primary Examiner*—M. Rachuba
(74) *Attorney, Agent, or Firm*—Evenson, McKeown, Edwards & Lenahan, P.L.L.C.

(57) ABSTRACT

A grindstone adapter, in which a drive force transmitted portion and plural stop projections are formed on a central boss of a disc-like pad to which a grindstone disc or a grindstone is attached, a drive portion fitting in the drive force transmitted portion and stop concave portions engaging with the stop projections are formed on a drive-side coupling fitting in the boss, and a depression cylinder which is urged by a spring toward a side for maintaining an engaging state between the stop projections and the stop concave portions, is formed on the drive side coupling.

6 Claims, 6 Drawing Sheets

GRINDSTONE ADAPTER

BACKGROUND OF THE INVENTION

This invention relates to a grindstone adapter which enables to remove and attach of a grindstone one-touch for use in electric tools and air tools such as a hand polisher, a disc grinder, and a disc sander etc. equipped with a grindstone having a small diameter (smaller than 125 mm, for example) and operated at low speed (a revolution speed smaller than 4,000 rpm, or a peripheral speed smaller than 1,000 m/min, for example).

A one-touch removable device which enables engaging/disengaging between a drive-side coupling (input boss) connected to a motor (reducer) output shaft for a hand polisher and a grindstone holder (grindstone pad etc.), has so far been proposed in various types (Japanese Unexamined Utility Model Publication No. 58-55845, No. 58-8562 & No. 62-8063). However, these devices are tools for holding their engaging states by utilizing a friction of engaging portions between a drive-side coupling and a grindstone holder or a friction of an elastic ring installed between the two, so that these devices offer a small holding force and are apt to be disengaged. Also, these devices are ready to be worn out due to vibration which will occur when transferring a torque, and still more apt to be disengaged due to looseness. Since a centering function for maintaining the grindstone holder at its center is weak, the device is more easily affected by the vibration from this aspect too and readily suffered from an abnormal wear of the grindstone and run-out of its center. Further, there has been such a trouble that the holder is disengaged when a torque is applied to it in a reverse direction.

BRIEF SUMMARY OF THE INVENTION

An object of this invention is to enhance the holding ability of the inserting portion of the drive-side coupling with the grindstone holder, to prevent disengagement between the two even when a torque is applied to them in either normal or reversed direction, to prevent wear and noise generated by torsional vibration etc. to keep a centering function stably for a long period, and to enable to remove and attach of the grindstone one-touch.

A first invention as set forth in claim 1 is a grindstone adapter, in which a drive force transmitted portion and plural stop portions are formed on a central boss of a disc-like pad secured to a grindstone disc or a grindstone, a drive portion fitting in the drive force transmitted portion and stop concave portions engaging with the stop projections are formed on a drive- side coupling fitting in the boss, and a depression cylinder which is urged by a spring toward a side for maintaining an engaging state between the stop projections and the stop concave portion is formed on the drive-side coupling.

A second invention as set forth in claim 2 is a grindstone adapter, in which the drive force transmitted portion and the plural stop portions are formed on an approximately same circle.

A third invention as set forth in claim 3 is a grindstone adapter, in which the grindstone disc is molded solidly with the disc-like pad.

A fourth invention as set forth in claim 4 is a grindstone adapter, in which the grindstone disc is provided with cooling water passages located at positions apart from its center.

DETAILED DESCRIPTION OF THE INVENTION

Figure 1:
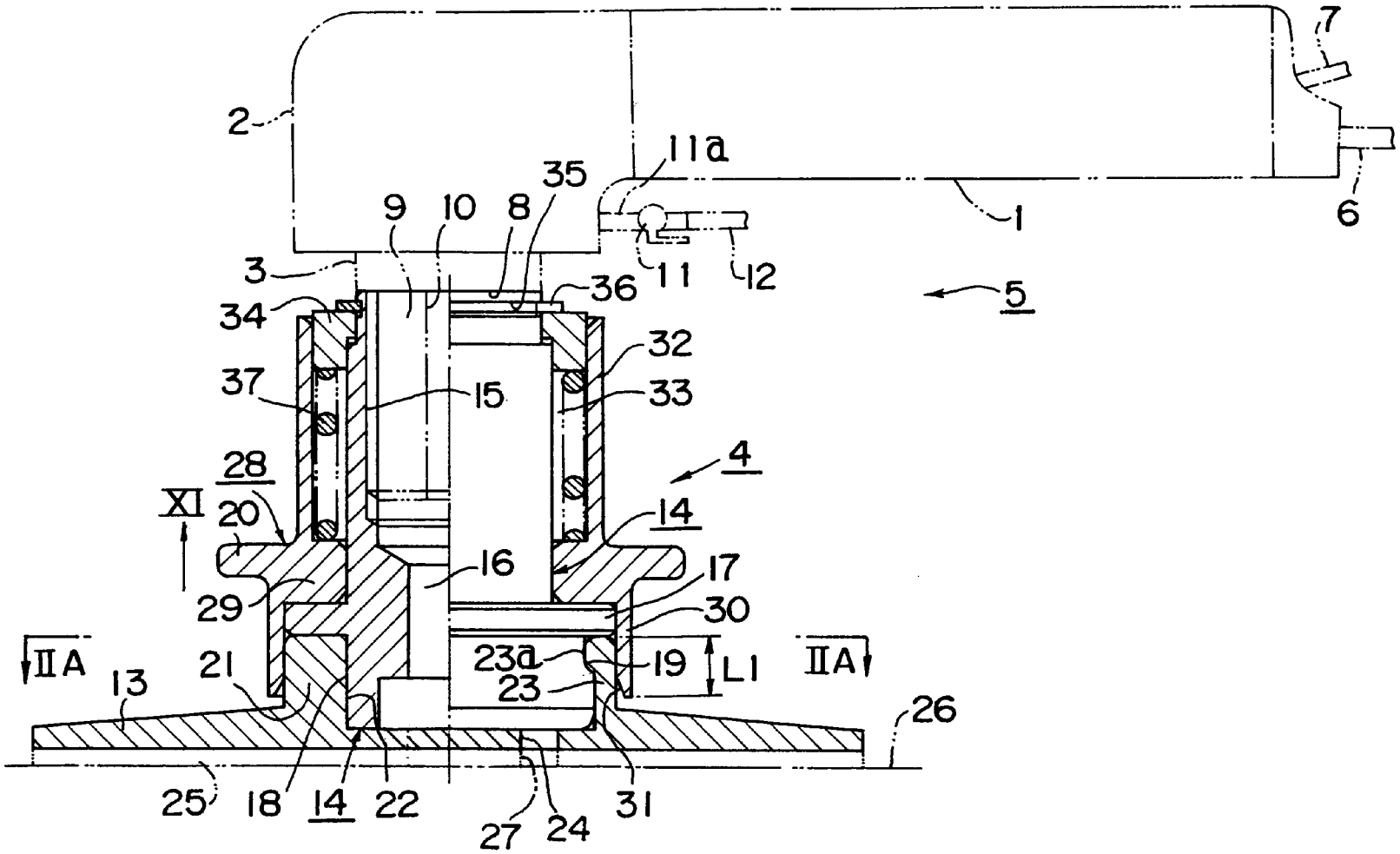
FIG. 1 is a vertical sectional front view of this invention when applied to a hand polisher.

FIG. 1 is a vertical sectional front view of a hand polisher 5 under a state where a grindstone adapter 4 of this invention is equipped to an output spindle 3 protruding downward from a gear box 2 attached to a tip end of a grip body 1. A not-shown motor assembled in the grip body 1 is connected through a cable 6 to a household power supply and switched on and off by a switch 7, and an output shaft at tip end (left end) of the motor is coupled through reduction gears in the gear box 2 to the output spindle 3 protruding downward. The output spindle 3 is provided with a stepped portion 8, a male screw portion 9 (right-hand thread) located thereunder, and a cooling water passage 10 located at its center. A top end of the cooling water passage 10 is connected to city water (not shown) through a nipple 11*a* with an adjusting cock 11 installed at a side of the gear box 2 and a hose 12. A flow of cooling water can be adjusted by the adjusting cock 11, and the above-mentioned structure is generally well known.

The male screw portion 9 of the output spindle 3 is screwed into a female screw portion 15 cut at an upper-half part of a drive-side cylindrical coupling 14 at a central part of the grindstone adapter 4, and the stepped portion 8 is pressed onto an upper surface of the drive-side coupling 14. 16 is a cooling water passage. A disc-like flange 17 is integrally formed on an outer peripheral face at a roughly middle height of a lower half of the drive-side coupling 14, and an approximately triangular horizontal section having R (rounded part) at its top is provided on an outer peripheral face at lower part of the flange 17, thus forming an approximately triangle pole. This approximately triangle pole forms a drive portion 18 for transmitting a torque to a disc-like pad 13 which will be described later, and a stop concave portion 19 having a groove with a roughly arc-section is formed on top portion (immediately below the flange 17) of the top of the horizontal section of the approximately triangle pole.

Figure 2A:
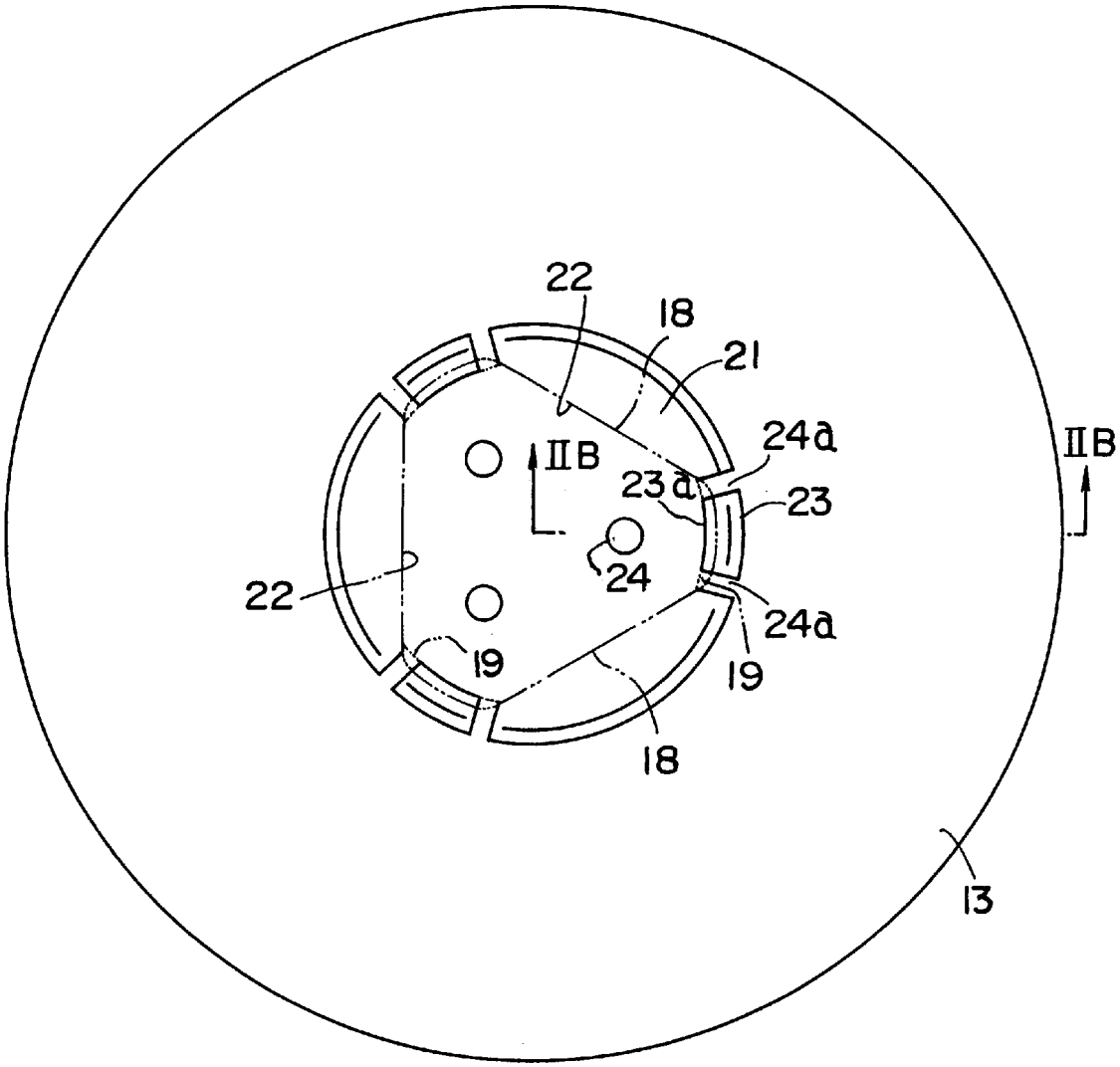
FIG. 2A is a plan view viewed in direction of arrows IIA—IIA showing a pad single body of FIG. 1.
Figure 2B:
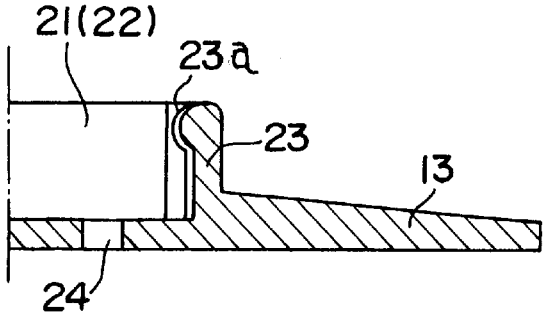
FIG. 2B is a sectional view taken on a line IIB—IIB of FIG. 2A.

The disc-like pad 13 includes at its center a roughly cylindrical boss 21 which includes an outer peripheral cylindrical surface having the same diameter as that of the flange 17. The boss 21 has three drive force transmitted portion 22 engaging with the triangle-pole-like drive portion 18 and thin partially cylindrical stop portions 23 standing upward between the neighboring drive force transmitted portions 22, and expanded portions 23*a* formed on top end internal faces of the stop portions 23 fit in the stop concave portions 19. The above structure can be understood from the fact that, in FIG. 2A viewed in direction of arrows IIA—IIA of FIG. 1, the approximately triangular drive portions 18 fit onto the approximately triangular drive force transmitted portions 22 and the expanded portions 23*a* of the stop projections 23 fit onto the stop concave portions 19 in an independent flexible manner through clearances 24*a*, so that the disc-like pad 13 can receive a torque from the drive-side coupling 14 and a stopping ability is probably realized by the engagement of the expanded portions 23*a* of the stop portions 23 in the stop concave portions 19. FIG. 2B is the sectional view taken on the line IIB—IIB of FIG. 2A, and 24 of FIG. 1, FIG. 2A and FIG. 2B are equally spaced three cooling water passages disposed on the same circle located apart from its center. Resin such as polycarbonate, polypropylene, nylon etc. for example, which are comparatively hard and have flexibility, are suitable for a material of the disc-like pad 13 of FIG. 1, and a diamond grindstone disc 25 is integrally secured to a lower surface of it. The grindstone disc 25 can be bonded to the lower surface of the disc-like pad 13 or can be secured thereto by a surface fastener. However, manufacturing process and cost can be reduced when the disc-like pad 13 is fabricated under a state where the previously manufactured disc 25 is set in a mold (not shown) and the both are integrated simultaneously with the molding. Naturally, it is possible to eliminate the disc-like pad 13 by integrally molding the boss 21 with the grindstone disc 25. 26 is a ground surface of a floor or a wall for a gravestone or a marble. As described above, in the embodiment of FIG. 1, a drive force transmitting portion i.e. the drive force transmitted portion 22 and a pad stop portion i.e. the stop concave portions 19 and the stop projections 23 are installed on the roughly same circle. Therefore, a height of this part is shortened and a height of the grindstone adapter 4 is shortened too, thereby an operability can be improved and the vibration of grindstone can be reduced as far as possible. The drive force transmitted portion 22 may be formed into a polygon such as a square etc., and a noncircular shape such as an ellipse etc. 27 is a cooling water passage provided in the grindstone disc 25, which is so disposed as to connect to the cooling water passage 24.

28 is a depression cylinder. A thick body portion 29 located at an intermediate height fits at its inside surface slidably onto an outer peripheral surface of the coupling 14 positioned at upper part of the flange 17, and has an annular flange 20 integrally on its external side. A cylindrical portion 30 extending downward from an outer peripheral part of the body portion 29 fits at its inside surface slidably onto outer peripheral surfaces of the flange 17 and the boss 21 so as to maintain engagement between the stopping concave portion 19 and the expanded portion 23*a* for the stop projection portion. 31 is a downward opening tapered guide surface provided at a bottom inside surface of the cylindrical portion 30. A cylindrical portion 32 extends integrally upward from an upper face of the body portion 29, an internal diameter of the cylindrical portion 32 is made larger than that of the coupling 14 located at upper part of the flange 17. An annular spring stop collar 34 fits in a top end of an annular space 33 existing between the two, and the collar 34 is prevented from slipping off toward upside by a snap ring 36 (E-ring) snapped in a ring groove 35 made at top end of the coupling 14. A coupling spring 37 is installed between the collar 34 and the body portion 29 in a compressed manner. The spring 37 shown here comprises a compression spring, which always urges the depression cylinder 28 downward to make the lower surface of the body portion 29 depress the flange 17 and make the cylindrical portion 30 positively prevent the stop portion 23 from expanding out in radial external direction (escape of the expanded portion 23*a* from the stop concave portion 19). The coupling 14, the depression cylinder 28 and the collar 34 may be made of SUS or brass, however, they can be made of resin such as polycarbonate, polypropylene, nylon etc., for example, in the same way as the pad 13. In this case, the adapter can be reduced in its weight and manufacturing cost. A coil spring made of resin, a thin cylinder made of rubber-like elastic body, a bellows having an corrugated section, a disc spring made of metal or resin (disposed alternately) etc. may be used in place of the spring 37 (made of spring steel). In this case, a height of the spring accommodating space 33 can be lessened within a range of affording a minimum releasing amount L1 necessary for releasing the stop portion 23, so that a downward protruding length of the grindstone adapter 4 can be reduced to allow the reduction of weight and manufacturing cost and the improvement in operability. In order to enable grinding on concave and curved surfaces of stone material, it is effective to decrease a thickness of the pad 13 down to 0.5~1.5 mm, or to increase its flexibility by using a soft resin such as urethane group resin for its material.

In order to grind a ground surface 26, an operator grips the grip body 1 with his right hand and turns on the switch 7 to drive the motor. Then, the spindle 3 rotates clockwise when viewed from upside, a torque is transmitted from a drive portion 18 of the driving side coupling 14 through the drive force transmitted portion 22 to the pad 13, and the grindstone disc 25 fabricated solidly with the pad 13 rotates to carry out a grinding work. During this work, water fed from the hose 12 is supplied through cooling water passages 10, 16, 24 & 27 etc. in between the grindstone disc 25 and the ground surface 26 so that the both are cooled and dust is prevented from being scattered. The grinding work is generally carried out in such a way that the grindstone is changed from a coarse stone to a fine stone stepwise and a quantity of cooling water is gradually lessened. When exchanging the grindstone to a coarse stone, the switch 7 is to be turned off to stop the grindstone adapter 4, and the flange 20 is to be lifted up with fingers utilizing the gear box 2 as a support point by a length larger than the release amount L1 upward (in a direction of arrow X1) against a spring force of the spring 37 under a condition where the cock 11 is closed or opened as it is. Thereby, the stop projections 23 are released, and the pad 13 is to be lowered under this state. Thus, the stop projections 23 are deformed in radial external directions to allow the expanded portions 23*a* to escape downward from the stop concave portions 19, so that the pad 13 can be taken out. In the next stage, under a state where the depression cylinder 28 is lifted up by a height larger than L1, the pad 13 equipped with a slightly finer disc is to be pushed up to the condition of FIG. 1 so as to fit the expanded portions 23*a* in the stop concave portions 19 to release the depression cylinder 28. The depression cylinder 28 is lowered by the elastic force of the spring 37 down to the condition of FIG. 1, and holds the stop projections 23 from radial external sides. Therefore, the cylinder securely prevents the grindstone disc 25 from slipping off even when the switch 7 is turned on next time to carry out the grinding work again.

Figure 3:
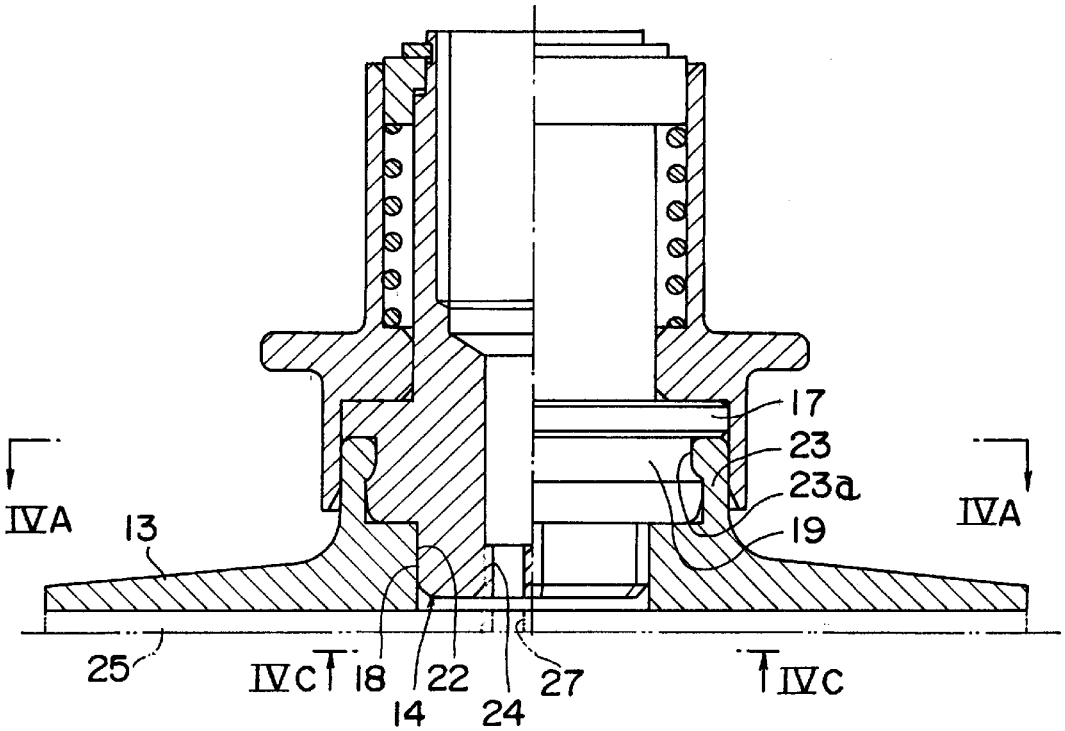
FIG. 3 is a vertical sectional front view showing another embodiment.
Figure 4A:
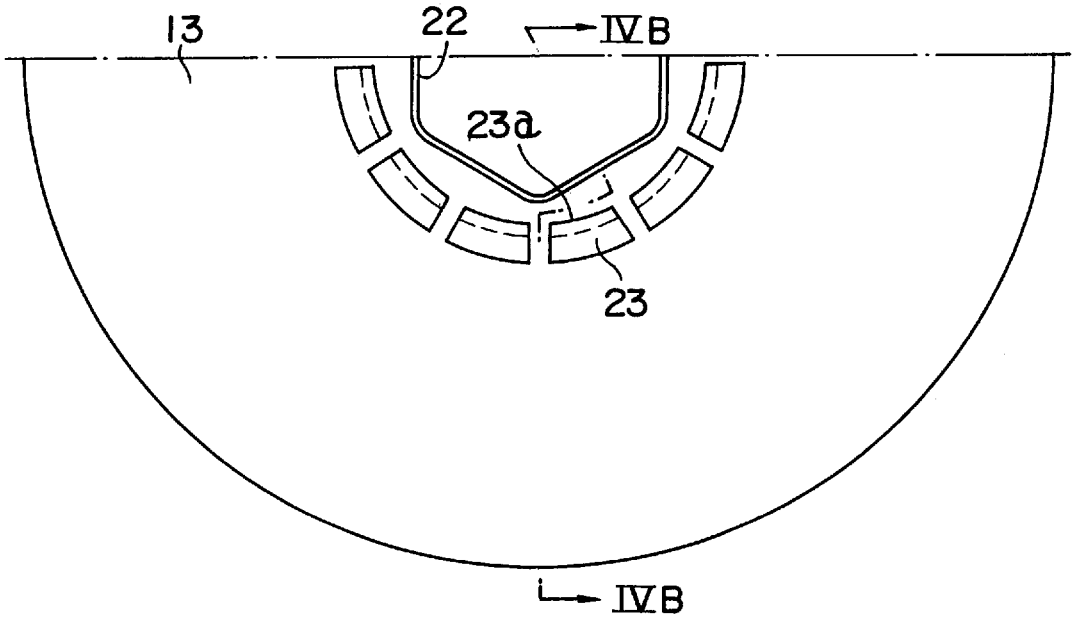
FIG. 4A is a partial plan view viewed in direction of arrows IVA—IVA showing a pad single body of FIG. 3.
Figure 4B:
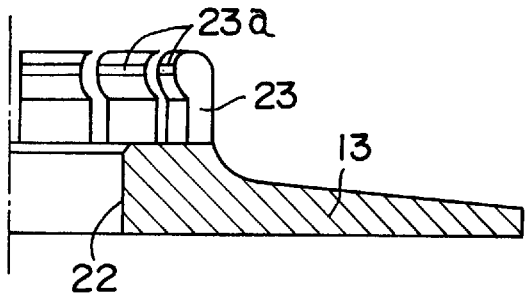
FIG. 4B is a sectional view taken on a line IVB—IVB of FIG. 4A.
Figure 4C:
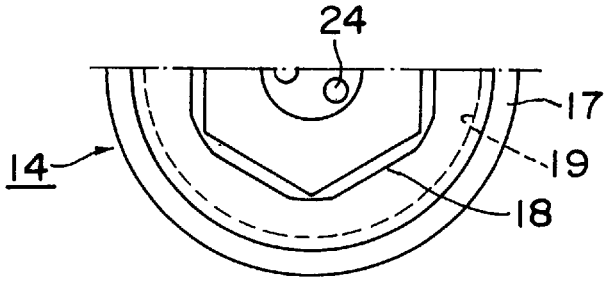
FIG. 4C is a partial bottom view viewed in direction of arrows IVC—IVC of a drive-side coupling single body of FIG. 3.

FIG. 3, FIG. 4A, FIG. 4B and FIG. 4C show another embodiment, and parts and components attached with symbols same as those used in FIG. 1, FIG. 2A and FIG. 2B represent parts and components corresponding thereto. In FIG. 3, the drive-side coupling 14 has a hexagonal polar drive portion 18 at its lower end (refer to FIG. 4C) and has the stop concave portion 19 (annular groove) at its upper end. The disc-like pad 13 has a central hexagon-hole-like driving force transmitted portion 22 and twelve annularly disposed stop projections 23 (FIG. 4A) surrounding the above. The drive portion 18 fits in the drive force transmitted portion 22 of the disc-like pad 13, and the expanded portion 23*a* of the stop projection 23 engages with the stop concave portion 19. This structure is different from that of FIG. 1 in a point that the fitting section of the drive portion 18 and the drive force transmitted portion 22 is located near to a bottom part and the engaging section of the expanded portion 23*a* of the stop projection 23 with the stop concave portion 19 is located at a position higher than the above fitting-in section. According to this structure, a transmitting capacity of the drive force is increased and a stopping ability is improved owing to an increase in a number of the stop projection 23. The grindstone disc 25 may be securely attached to a bottom face of the pad 13 as illustrated in FIG. 1, however, the pad 13 itself may be molded solidly with a material of the grindstone disc. The removal work of grindstone is similar to that of FIG. 1.

Figure 5:
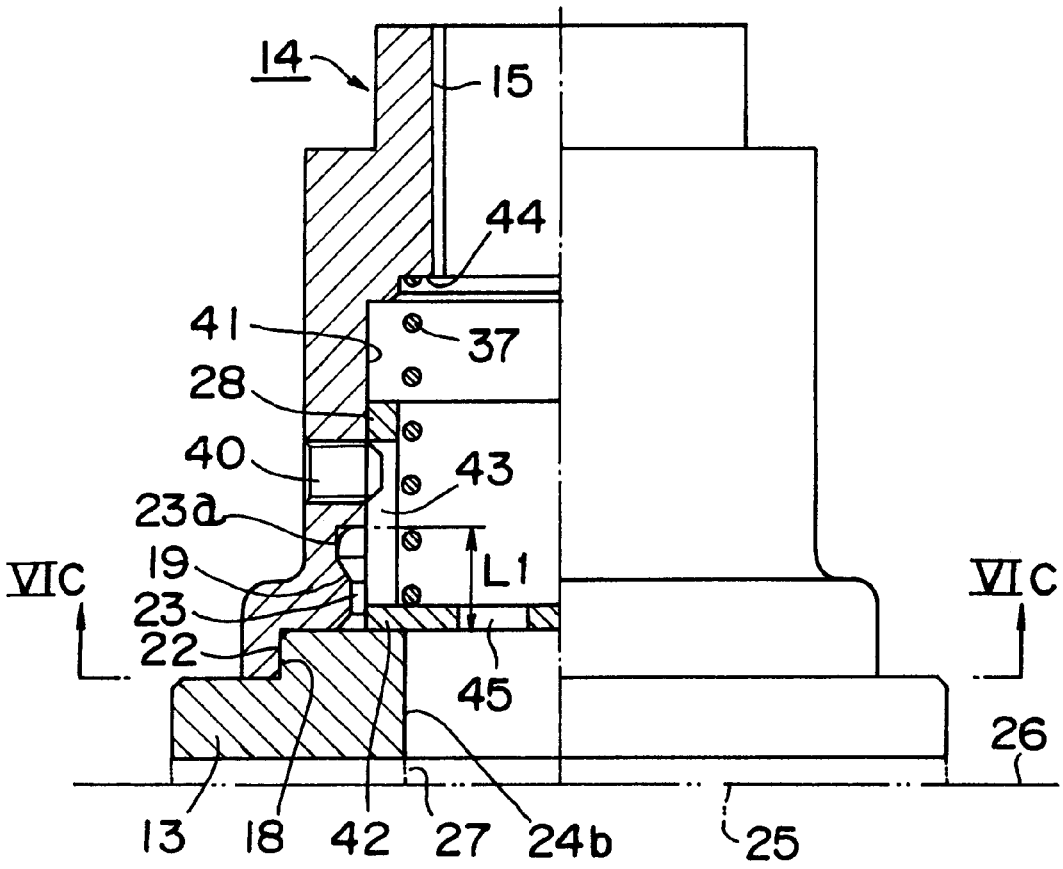
FIG. 5 is a vertical sectional front view showing further another embodiment.
Figure 6A:
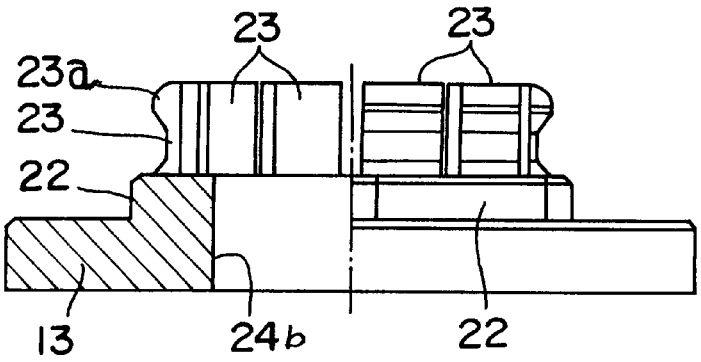
FIG. 6A is a partially sectional vertical front view of a pad single body of FIG. 5.
Figure 6B:
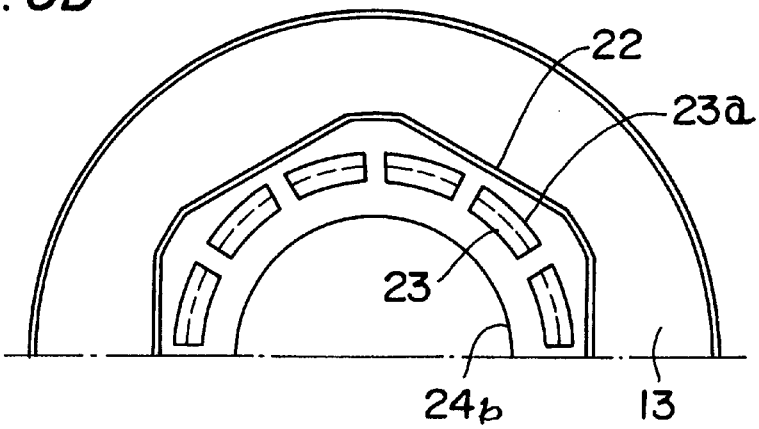
FIG. 6B is a partial plan view of the same.
Figure 6C:
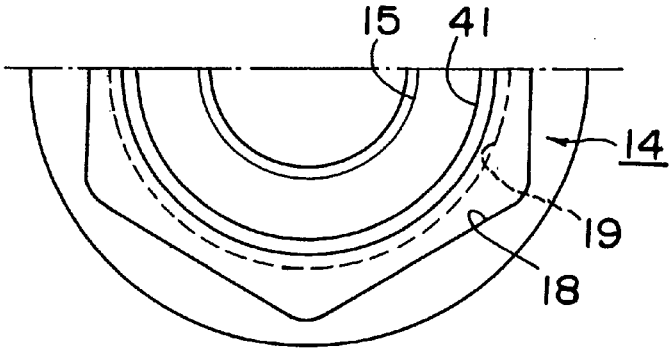
FIG. 6C is a partial bottom view viewed in direction of arrows VIC—VIC of a drive-side coupling single body of FIG. 5.

FIG. 5, FIG. 6A, FIG. 6B and FIG. 6C show further another embodiment, and parts and components attached with symbols same as those used in FIG. 1, FIG. 2A and FIG. 2B represent parts and components corresponding thereto. In FIG. 5, the drive-side coupling 14 has a hexagonal-hole-like drive portion 18 at its lower end (refer to FIG. 6C), an annular stop concave portion 19 located at an upper internal surface and a set screw 40 screwing in an radial threaded hole located at a further upper part. The disc-like pad 13 has a hexagonal polar drive force transmitted portion 22 (refer to FIG. 6A & 6B) and twelve stop projections 23 annularly standing up at its upper part, and these stop projections 23 include at their upper ends expanded portions 23*a* expanding in radial external directions. A depression cylinder 28 (inner lock) fits slidably in an cylindrical internal surface 41 of a coupling 14. The depression cylinder 28 integrally has a release disc 42 at its lower end, and slits 43 extending vertically are formed at two spots on a peripheral surface of the depression cylinder 28. The set screw 40 fits in the slit 43 so as to prevent the depression cylinder 28 from falling down when the pad 13 is taken out. A spring 37 is installed between the disc 42 and a stepped portion 44 of the coupling 14, in a compressed manner. 45 is a hole for air vent and made at three places on the same circle.

In order to take out the pad from the state of FIG. 5; fingers are to be inserted upward in a hole 24*b* having a diameter larger than that of FIG. 1, the disc 42 is to be pushed up against an elastic force of the spring 37 by a height larger than the release amount L1, the pad 13 is to be pulled down under a state where the stop projections 23 are released, and the expanded portions 23*a* are to be released from the stop concave portions 19 by deforming the stop projections 23 in radial internal directions. When the upward force applied on the disc 42 under a condition that the pad 13 is taken out, a combined body of the depression cylinder 28 and the disc 42 are lowered by the force of the spring 37 down to a position shown in the figure in which the set screw 40 contacts with a top end of the slit 43. In order to equip a further finer pad 13, the pad 13 is to be pushed up under the condition that the disc 42 is pushed upward through the hole 24*b* by a length larger than the L1, and the stop projections 23 are to be engaged with the stop concave portions 19. Thus the disc 42 can be released. Thereby, the depression cylinder 28 is lowered by the spring 37 down to the position shown in the figure, so that a dangerous slipping off of the stop projections 23 from the stop concave portions 19 in radial internal directions can positively be avoided. According to the structure of FIG. 5, the transmitting capacity of the drive force is increased, and the stopping ability is improved too owing to the increase in the number of the stop projection 23. The grindstone disc 25 may be securely attached to the bottom face of the pad 13 as illustrated in FIG. 1, however, the pad 13 itself may be molded solidly with a material of the grindstone disc.

According to the first invention, the engaging state of the stop projection 23 with the stop concave portion 19 is surely retained (holding force is increased) by fastening the stop projection 23 using the depression cylinder 28. A possibility of occurrence of friction and chattering is eliminated from the engaging section between the stop projection 23 and the stop concave portion 19, even after a long term operation under severe conditions or even when either normal or reverse torque is applied thereto. The pad 13 can be prevented positively from slipping-off or chattering during operation. Consequently, an occurrence of wear or noise caused by torsional vibration etc. can certainly be avoided. In addition, it becomes possible to attach and detach the grindstone pad by almost one-touch operation, so that its handling becomes easy. Its manufacturing cost can be reduced owing to the simple structure.

According to the second invention, as shown in FIG. 1, the plural stop projections 23 are formed within a height range of the drive force transmitted portion 22, i.e. an approximately same circle. Therefore, heights of the drive force transmitting portion and the stop portion can be reduced as far as possible so that a workability of the grinding work can be improved. The reduction in height of the grindstone adapter 4 will eliminate a run-out of the grindstone and will be effective for an improvement in a finishing accuracy.

According to the third invention, as shown in FIG. 1, an operation for surely attaching the grindstone disc 25 to the disc-like pad 13 becomes simple. Therefore, this is effective for a reduction in the manufacturing cost, and a concentricity between the two can be assured easily so that a finishing accuracy can be improved.

According to the fourth invention, since water which is discharged from the cooling water passages 27 located at eccentric positions during operation, is scattered in radial directions by centrifugal force along a bottom surface of the grindstone disc 25, it is possible to feed scattered cooling water on the ground surface and to improve the grinding efficiency even when grinding an approximately perpendicular bottom edge of a trough put upside down (even if a lower half of the grindstone disc 25 is exposed downward). Namely, when only one cooling water passage of the grindstone disc 25 is provided at its center, cooling water can not be fed to the ground surface in the case of the above-mentioned example. However, it becomes possible to surely avoid such a trouble according to this invention. Water will be spread well to every corner when floors are ground.

What is claimed is:

1. A grindstone adapter for engaging a drive comprising:

a disk pad to which a grindstone is attached wherein said disk pad has a central boss with a drive force transmitting portion and a plurality of flexible stop projections being formed on said central boss wherein each of said Plurality of said flexible stop projections includes an expanded portion and wherein said drive is fitted in said drive force transmitting portion;

a drive portion including a drive side coupling fitting in said boss, said drive side coupling including a plurality of individual stop concave portions, each said expanded portion of said plurality of said flexible stop projections axially engages with a respective individual stop concave portion to thereby lock said concave portions with said stop projection to prevent rotational movement; and a depression cylinder axially urged by a spring in order to maintain an engaging state between said plurality of said flexible stop projections and said individual stop concave portions, wherein said depression cylinder is formed on said drive side coupling.

2. The grindstone adapter as set forth in claim 1, in which the grindstone is molded solidly with the disk pad.

3. The grindstone adapter as set forth in claim 1, in which the grindstone is provided with cooling water passages located at positions apart from its center.

4. The grindstone adapter according to claim 1, wherein said depression cylinder slidably fits onto an outer peripheral surface of said drive side coupling and wherein said plurality of said stop projections are located proximal, in an axial direction, to said drive force transmitted portion.

5. The grindstone adapter according to claim 1, wherein said plurality of said stop projections are spaced apart, in an axial direction, from said drive force transmitted portion.

6. The grindstone adapter according to claim 1, wherein said depression cylinder slidably fits in a cylindrical internal surface of said drive side coupling.

* * * * *